United States Patent [19]

Dombrowski, Jr. et al.

[11] Patent Number: 4,904,572

[45] Date of Patent: Feb. 27, 1990

[54] THERMOGRAPHIC RECORDING MATERIALS AND COATING COMPOSITION THEREFOR

[75] Inventors: Edward J. Dombrowski, Jr., Cambridge; Patrick F. King, North Quincy, both of Mass.

[73] Assignee: Polaroid Corporation, Cambridge, Mass.

[21] Appl. No.: 182,966

[22] Filed: Apr. 18, 1988

[51] Int. Cl.[4] ..... G03C 1/40

[52] U.S. Cl. ..... 430/332; 430/338; 430/341; 430/620; 430/944; 430/964; 503/218

[58] Field of Search ..... 430/332, 338, 341, 363, 430/944, 964, 618, 620; 503/218, 220, 221, 224

[56] References Cited

U.S. PATENT DOCUMENTS

| | | | |
|---|---|---|---|
| 4,306,014 | 12/1981 | Kunikane et al. | 430/338 |
| 4,379,835 | 4/1983 | Lowrey et al. | 430/338 |
| 4,720,449 | 1/1988 | Borror et al. | 430/338 |
| 4,745,046 | 5/1988 | Borror et al. | 430/332 |

FOREIGN PATENT DOCUMENTS

WO87/03541 6/1987 PCT Int'l Appl.

*Primary Examiner*—Paul R. Michl
*Assistant Examiner*—Mark R. Buscher
*Attorney, Agent, or Firm*—Stanley H. Mervis

[57] ABSTRACT

This invention relates to the use of 3,5-dihydroxybenzoic acid as an organic acidic reagent in thermographic recording materials comprising a di- or triarylmethane thiolactone dye precursor, silver behenate and a polymeric binder, and in a further embodiment, relates to coating compositions useful in the preparation of the recording materials.

11 Claims, No Drawings

THERMOGRAPHIC RECORDING MATERIALS AND COATING COMPOSITION THEREFOR

BACKGROUND OF THE INVENTION

Color-forming di- and triarylmethane compounds possessing certain S-containing ring-closing moieties, namely, a thiolactone, dithiolactone or thioether ring-closing moiety are disclosed in International Application No. PCT/US86/02685 published June 18, 1987 as International Publication No. WO87/03541. These dye precursors are rendered colored by contacting with a Lewis acid material capable of opening the S-containing ring moiety. Preferably, the Lewis acid material is a metal ion of a heavy metal with silver ion being particularly preferred.

As disclosed therein, these dye precursors and Lewis acid materials find utility in a wide variety of color-forming applications including the formation of dye images where color formation is brought about in an imagewise fashion by the imagewise application of heat, pressure or other stimulus necessary to effect contact between the dye precursor and Lewis acid material. In a preferred embodiment, thermographic recording materials are provided which employ these dye precursors, particularly the thiolactones such as the thiophthalides in combination with an organic silver salt such as silver behenate. Preferably, these recording materials also include a polymeric binder such as polyvinylbutyral and a heat-fusible organic acidic material such as 3,5-diisopropylsalicylic acid or 4,4'-sulfonyldiphenol.

SUMMARY OF THE INVENTION

The present invention is concerned with the use of a particular organic acidic material in thermographic recording materials employing thiolactone dye precursors and silver behenate as the color-forming components and with a one-pot coating fluid that may be employed in their preparation. In particular, it has been found that the use of 3,5-dihydroxybenzoic acid as the heat-fusible acidic material with these color-forming components provides thermographic recording materials having improved Dmax/Dmin characteristics together with good storage stability. Also, it has been found quite unexpectedly that 3,5-dihydroxybenzoic acid can be combined with these color-forming components to give a one-pot coating fluid stable enough to coloration to be applied by a single delivery system in large scale coating operations thereby obviating the need for two separately coated layers or for blending two separate coating fluids at the time a single imaging layer is applied. Besides the convenience and other manufacturing advantages associated with a single coating fluid, thinner recording layers possessing the desired density characteristics can be obtained with lesser quantities of color-forming components and binder. Moreover, lesser quantities of this acidic material can be used to achieve a given Dmax in both one-pot coating compositions and inline blended compositions.

It is, therefore, among the objects of the present invention to provide thermographic recording materials and to provide one-pot coating compositions that may be used in the preparation of the recording materials.

DETAILED DESCRIPTION OF THE INVENTION

The di- and triarylmethane thiolactone compounds used as the dye precursors in the present invention may be represented by the formula

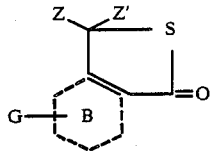

wherein ring B represents a substituted or unsubstituted carbocyclic aryl ring or rings, e.g., of the benzene or naphthalene series or a heterocyclic ring, e.g., pyridine or pyrimidine; G is hydrogen or a monovalent radical; and Z and Z' taken individually represent the moieties to complete the auxochromophoric system of a diarylmethane or a triarylmethane dye when said S-containing ring is open and Z and Z' taken together represent the bridged moieties to complete the auxochromophoric system of a bridged triarylmethane dye when said S-containing ring is open, i.e., when the ring sulfur atom is not bonded to the meso carbon atom. Usually, at least one of Z and Z' whether taken individually or together possesses as an auxochromic substituent, a nitrogen, oxygen or sulfur atom or a group of atoms containing nitrogen, oxygen or sulfur.

In the triarylmethane compounds represented in formula I above, the moieties Z and Z', when taken individually, may be the same or different and typically represent heterocyclic groups containing nitrogen, oxygen or sulfur as the heterocyclic atom, particularly N-heterocyclic groups such as julolidin-3-yl, indol-3-yl, pyrr-2-yl, carbazol-3-yl, and indolin-5-yl wherein the N atom of the indolyl, pyrryl, carbazolyl and indolinyl groups may be substituted with hydrogen or alkyl having 1 to 6 carbon atoms, or the moieties Z and Z' typically may be carbocyclic aryl, particularly phenyl or naphthyl groups which include an appropriately positioned auxochromic substituent, i.e., an atom or group that produces an auxochromic effect, which substituent is usually positioned para to the meso carbon atom. Typically, Z and Z' when taken together represent aryl groups bridged by a heteroatom, such as, oxygen, sulfur or nitrogen to form, for example, 4H-chromeno [2,3-C] pyrazole and particularly represent carbocyclic aryl groups, such as, phenyl groups bridged with a heteroatom, preferably oxygen, sulfur or nitrogen substituted with hydrogen or an alkyl group having 1 to 6 carbon atoms to provide a xanthene, thioxanthene or an acridine dye, which dyes possess an auxochromic substituent(s) para to the meso carbon atom, i.e., in the 3-position or in the 3,6-positions or meta and para to the meso carbon atom, i.e., in the 3,7-positions.

In the diarylmethane compounds, one of Z and Z' may be a heterocyclic group or carbocyclic aryl group as discussed above and the other of Z and Z' may be, for example, phenoxy, thiophenoxy, alkoxy containing 1 to 20 carbon atoms, alkylthio containing 1 to 20 carbon atoms, -N,N-(disubstituted)amino wherein each said substituent may be alkyl containing 1 to 20 carbon atoms, carbocyclic aryl containing 6 to 12 carbon atoms, aralkyl containing 7 to 15 carbon atoms particularly phenyl- and naphthyl-substituted alkyl or alkaryl containing 7 to 15 carbon atoms particularly alkyl-substituted phenyl and naphthyl. Representative alkyl groups include methyl, butyl, hexyl and octadecyl and representative aryl groups include phenyl and naphthyl. Representative alkaryl groups include p-octylphenyl, o-methylnaphthyl and p-hexylphenyl, and representative aralkyl groups include phenethyl, benzyl and naphthylmethyl.

Examples of useful auxochromic substituents include $—OR_1$ wherein $R_1$ is hydrogen, alkyl usually having 1 to 6 carbon atoms, aralkyl usually having 7 to 15 carbon atoms, alkaryl usually having 7 to 15 carbon atoms or carbocyclic aryl usually having 6 to 12 carbon atoms; $—SR_2$ wherein $R_2$ has the same meaning given for $R_1$; $—NR_3R_4$ wherein $R_3$ and $R_4$ each represent hydrogen, alkyl usually having 1 to 6 carbon atoms, β-substituted ethyl, cycloalkyl usually having 5 to 7 carbon atoms, aralkyl usually having 7 to 15 carbon atoms, alkaryl usually having 7 to 15 carbon atoms or

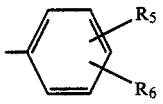

wherein $R_5$ and $R_6$ each are hydrogen, alkyl usually having 1 to 6 carbon atoms, halo such as chloro, bromo, fluoro and iodo, nitro, cyano, alkoxycarbonyl wherein said alkoxy has 1 to 6 carbon atoms, sulfonamido ($—NHSO_2R_0$), sulfamoyl ($—SO_2NHR_0$), sulfonyl ($—SO_2R_0$), acyl ($—COR_0$) or carbamyl ($—CONR_0$) wherein $R_0$ usually is alkyl having 1 to 20 carbon atoms, benzyl or phenyl and $R_3$ and $R_4$ taken together represent the atoms necessary to complete a heterocyclic ring usually piperidino, pyrrolidino, N-methylpiperidino, morpholino or

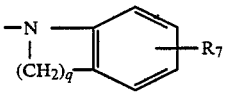

wherein q is an integer 2 to 5 and $R_7$ has the same meaning as $R_5$,

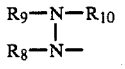

wherein $R_8$ and $R_9$ each are hydrogen, alkyl usually having 1 to 6 carbon atoms or

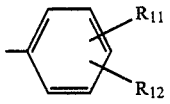

wherein $R_{11}$ and $R_{12}$ have the same meaning as $R_5$ and $R_6$ and $R_{10}$ is $—COR_{13}$, $—CSR_{13}$ or $—SO_2R_{13}$ wherein $R_{13}$ is hydrogen, alkyl usually having 1 to 6 carbon atoms, phenyl, $—NH_2$, $—NHR_{14}$, $—N(R_{14})_2$ or $—OR_{14}$ wherein $R_{14}$ is hydrogen, alkyl usually containing 1 to 6 carbon atoms or phenyl. Representative alkyl groups include methyl, ethyl, propyl, butyl and hexyl. Representative β-substituted ethyl groups include β-methoxymethoxyethyl and β-2'-tetrahydropyranyloxyethyl. Representative aralkyl groups include phenyl and naphthyl-substituted alkyl, such as, benzyl, phenethyl and naphthylmethyl and representative alkaryl groups include alkyl-substituted phenyl and naphthyl, such as, o-methylphenyl, o-methylnaphthyl and p-hexylphenyl. Representative carbocyclic aryl groups include phenyl and naphthyl and representative cycloalkyl groups include cyclopentyl, cyclohexyl and cycloheptyl. It will be appreciated that the auxochromic substituent(s) will be selected for a given diarylmethane, triarylmethane or bridged triarylmethane compound to provide the desired chromophore color upon opening of the S-containing ring and to achieve facile color formation.

In addition to the auxochromic substituents, the subject dye precursor compounds may possess one or more additional substituents on Z and/or Z' and/or ring B as may be desired that do not interfere with the intended utility for the dye. Typical substituents for Z and/or Z' and for G include carboxy; hydroxy; cyano; thiocyano; mercapto; sulfo; nitro; sulfonamido ($—NHSO_2R_0$); sulfamoyl ($—SO_2NHR_0$); sulfonyl ($—SO_2R_0$); acyl ($—COR_0$); carbamyl ($—CONR_0$); halomethyl such as trifluoromethyl; alkyl usually having 1 to 20 carbon atoms such as methyl, octyl, hexadecyl; alkoxy usually having 1 to 20 carbon atoms such as methoxy, ethoxy, propoxy and butoxy; alkoxycarbonyl having 1 to 20 carbon atoms such as ethoxy- and dodecyloxycarbonyl; aralkyl usually having 7 to 15 carbon atoms, for example, phenyl- or naphthyl-substituted alkyl such as benzyl, phenethyl and naphthylmethyl; alkaryl usually having 7 to 15 carbon atoms, for example, alkyl substituted phenyl or naphthyl such as o-methylphenyl, o-methylnaphthyl and p-hexylphenyl; aralkyloxy usually having 7 to 15 carbon atoms, for example, phenyl- or naphthyl-substituted alkoxy such as benzyloxy, phenethyloxy and naphthylmethyloxy; aryloxy usually containing 6 to 12 carbon atoms such as phenoxy and naphthoxy; thioalkyl groups, usually having 1 to 20 carbon atoms such as methylthio, ethylthio and hexylthio; thioaryl and thioaralkyl groups containing up to 15 carbon atoms such as phenylthio, naphthylthio, benzylthio and phenethylthio; halo such as chloro, bromo, fluoro and iodo; amino including mono- and disubstituted amino such as $—NR_{15}R_{16}$ wherein $R_{15}$ and $R_{16}$ each are hydrogen, alkyl usually having 1 to 20 carbon atoms, aralkyl usually having 7 to 15 carbon atoms and aryl having 6 to 12 carbon atoms; and a fused substituent such as a fused benzene ring.

In a preferred embodiment, B is a benzene ring and Z and Z' taken individually or together complete the auxochromophoric system of a triarylmethane dye.

The dye precursor compounds used in the present invention can be monomeric or polymeric compounds. Suitable polymeric compounds are those which, for example, comprise a polymeric backbone chain having dye precursor moieties attached directly thereto or through pendant linking groups. Polymeric compounds of the invention can be provided by attachment of the dye precursor moiety to the polymeric chain via the Z and/or Z' moieties or the ring B. For example, a monomeric dye precursor compound having a reactable substituent group, such as an hydroxyl or amino group, can be conveniently reacted with a mono-ethylenically unsaturated and polymerizable compound having a functional and derivatizable moiety, to provide a polymerizable monomer having a pendant dye precursor moiety. Suitable mono-ethylenically unsaturated compounds for this purpose include acrylyl chloride, methacrylyl chloride, methacrylic anhydride, 2-isocyanatoethyl methacrylate and 2-hydroxyethyl acrylate, which can be reacted with an appropriately substituted dye precursor compound for production of a polymerizable monomer which in turn can be polymerized in known manner to provide a polymer having the dye precursor compound pendant from the backbone chain thereof.

The thiolactone dye precursors can be synthesized, for example, from the corresponding lactones by heating substantially equimolar amounts of the lactone and phosphorus pentasulfide or its equivalent in a suitable solvent. The silver behenate may be prepared in a conventional manner using any of various procedures well known in the art.

The one-pot coating compositions of the present invention are prepared by mixing the selected dye precursor, preferably, a thiophthalide and the 3,5-dihydroxybenzoic acid with a dispersion of silver behenate and polymer binder carried in a suitable organic liquid. The binder may be any of those commonly employed in silver behenate/polymer dispersions and preferably is polyvinylbutyral. The organic liquid employed preferably is methyl ethyl ketone. In addition to these named ingredients, the coating compositions may contain dispersing agents, surfactants, plasticizers, cross-linking agents, coating aids or other reagents as may be desired.

The resulting coating composition may be applied to paper, plastic film, metal foil or other support materials commonly used for recording elements or coated on any other substrate as desired by spray, air knife, slot, silk screen, reverse roll or other appropriate coating means. The coating may then be dried at ambient or slightly elevated temperatures.

Besides being useful in the production of monochromes having the desired color which is intended to include "black", the subject compositions also are useful in the production of multilayered recording materials for forming multicolor images. In this embodiment, the dye precursors generally are selected to give the subtractive colors cyan, magenta and yellow. Besides the imaging layer(s), it will be appreciated that additional layers may be present such as subbing layers, interlayers or barrier layers for thermally and chemically isolating the respective imaging layers from each other, infra-red absorbing layers, antihalation layers, antistatic layers, back coat layers, adhesive layers and so forth. Preferably, a protective topcoat or overcoat layer is employed which layer may contain ultraviolet absorbers, matting agents, waxes or other materials as commonly used in such layers.

Imagewise heating of the recording element for forming the color image may be effected by the direct application of heat by using, for example, a thermal printing head, by conduction from heated image-markings of an original using conventional thermographic copying techniques, by heat generated from an electrical signal by including an electroconductive layer or by converting electromagnetic radiation into heat, for example, by using an infra-red laser diode as a light source and including an infra-red absorber in the imaging layer for converting infra-red radiation into heat. In producing multicolor images, infra-red absorbers may be selected for the respective imaging layers that absorb at different predetermined wavelengths so that the respective layers may be imaged separately.

To illustrate the present invention, a number of heat-fusible organic acidic materials were compared at the same molecular level in a single layer containing the thiophthalide dye precursor shown below (Compound A) and silver behenate dispersed in polyvinylbutyral binder. The molar ratios employed were 1:2:2 dye precursor: silver: acidic material, respectively. The layers were coated out of methyl ethyl ketone on a transparent polyethylene terephthalate support using a #34 Meyer rod and air dried at room temperature. The coated samples were heated at 110° C. until a Dmax was reached, and then the maximum and minimum transmission densities (Dmax/Dmin) were measured for red (R) using a Macbeth transmission densitometer equipped with the appropriate filter.

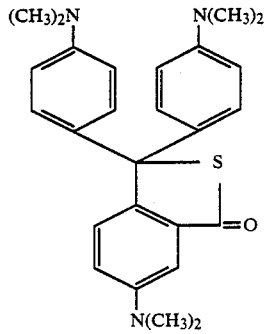

Compound A

The results obtained for those acidic materials exhibiting a Dmax of at least 1.00 are set forth below:

| Acidic Material | Dmax (R) | Dmin (R) |
|---|---|---|
| 2,5-Dihydroxybenzoic Acid | 3.78 | 0.10 |
| 3,5-Dihydroxybenzoic Acid | 3.35 | 0.03 |
| 2,3-Dihydroxybenzoic Acid | 3.34 | 0.10 |
| 3-Phenylsalicylic Acid | 3.29 | 0.20 |
| 3-Methyl-2-nitrobenzoic Acid | 3.24 | 0.05 |
| 5-Chlorosalicylic Acid | 3.18 | 0.33 |
| 5-Phenylsalicylic Acid | 3.18 | 0.13 |
| 2-Hydroxy-3-methylbenzoic Acid | 3.18 | 0.06 |
| Salicylic Acid | 3.17 | 0.08 |
| 3,5-Dibromosalicylic Acid | 3.14 | 0.84 |
| 3-Methoxysalicylic Acid | 3.12 | 0.07 |
| 3-Hydroxy-2-naphthoic Acid | 3.05 | 0.14 |
| Phthalic Acid | 3.00 | 0.12 |
| 3-Methylsalicylic Acid | 2.87 | 0.06 |
| a-Hydroxynaphthoic Acid | 2.82 | 0.09 |
| DL-Mandelic Acid | 2.80 | 0.04 |
| 5,5-Thiodisalicylic Acid | 2.71 | 0.48 |
| 3,5-Diisopropylsalicylic Acid | 2.68 | 0.05 |
| p-Hydroxyphenoxy acetic Acid | 2.53 | 0.03 |
| p-Bromomandelic Acid | 2.46 | 0.06 |
| 3-Hydroxy-4-nitrobenzoic Acid | 2.32 | 0.04 |
| m-Hydroxybenzoic Acid | 2.27 | 0.02 |
| p-Chloromandelic Acid | 2.27 | 0.06 |
| 5-Sulfosalicylic Acid | 2.18 | 1.88 |
| Benzylmalonic Acid | 2.15 | 0.05 |
| 4-Methyl-3-nitrobenzoic Acid | 1.96 | 0.03 |
| 2,6-Dihydroxybenzoic Acid | 1.94 | 0.26 |
| Citric Acid | 1.88 | 0.25 |
| o-Chlorobenzoic Acid | 1.29 | 0.03 |
| 3-Methy-4-Nitrobenzoic Acid | 1.25 | 0.04 |
| 4-Dimethylaminosalicylic Acid | 1.14 | 0.04 |
| 4,4'-Sulfonyldiphenol | 1.09 | 0.02 |
| 2-Pyridine Aldoxime | 1.07 | 0.03 |

From reference to the above data, it can be seen that a high Dmax together with a low Dmin was obtained using 3,5-dihydroxybenzoic acid as the heat-fusible acidic material in a single imaging layer prepared from a one-pot coating composition.

In a further comparison, the pot life of inline blended fluids for forming a single imaging layer was evaluated for the acidic materials, 3,5-dihydroxybenzoic acid and 3,5-diisopropylsalicylic acid. The amounts of reagents used in the fluids were calculated to give the coated coverages indicated in terms of mg/ft$^2$. In this comparison Fluid A comprised polyvinylbutyral (200 mg/ft$^2$) and Compound A (30 mg/ft$^2$) in methyl ethyl ketone, and Fluid B comprised the acidic material (50 mg/ft$^2$) polyvinylbutyral (100 mg/ft$^2$) and silver behenate (15 mg/ft$^2$ as silver) dispersed in methyl ethyl ketone. Upon mixing Fluids A and B, it was found that the mixture containing the 3,5-diisopropylsalicylic acid had a pot life of minutes with the onset of color occurring after only 30 seconds. In comparison, the mixture containing 3,5-dihydroxybenzoic acid was essentially colorless after one week thereby obviating the need for inline blending of two separate fluids for providing a single imaging layer.

Besides the color stability obtained by using 3,5-dihydroxybenzoic acid as the heat-fusible organic acidic material, the quantity of binder and other reagents employed in the one-pot composition can be reduced from the amounts used in inline blended fluids while still achieving a given Dmax/Dmin. As an illustration, two recording elements I and II employing 3,5-dihydroxybenzoic acid and a control element employing 3,5-diisopropylsalicylic acid were prepared by coating the imaging layers from methyl ethyl ketone on a transparent polyethylene terephthalate support followed by applying a topcoat layer. The protective topcoat layer comprised polyvinylalcohol coated at a coverage of 30 mg/ft$^2$, Quinlon C available from du Pont Company (chromium, pentahydroxy (tetradecanato) di-) coated at a coverage of 30 mg/ft$^2$ and Fluorad FC-100 available from the 3M Company (fluorochemical surfactant - fluorinated alkyl amphoteric mixture) coated at a coverage of 1 mg/ft$^2$. The imaging layer for each element and the Dmax/Dmin (Red) measured by transmission for the heated and unheated portions of each are set forth below.

Control Element
Topcoat Layer
Imaging Layer—inline blend of (1) and (2)
(1) polyvinylbutyral coated at a coverage of 200 mg/ft$^2$ and Compound A coated at a coverage of 30 mg/ft$^2$;
(2) polyvinylbutyral coated at a coverage of 100 mg/ft$^2$, silver behenate coated at a coverage of 15 mg/ft$^2$ silver and 3,5-diisopropylsalicylic acid coated at a coverage of 50 mg/ft$^2$.
Transparent Support
Dmax/Dmin 1.3/0.04

Element I
Topcoat Layer
Imaging Layer—inline blend of (1) and (2)
(1) polyvinylbutyral coated at a coverage of 200 mg/ft$^2$ and Compound A coated at a coverage of 30 mg/ft$^2$;
(2) polyvinylbutyral coated at a coverage of 100 mg/ft$^2$, silver behenate coated at a coverage of 11 mg/ft$^2$ silver and 3,5-dihydroxybenzoic acid coated at a coverage of 25 mg/ft$^2$
Transparent Support
Dmax/Dmin 1.3/.04

Element II
Topcoat Layer
Imaging Layer—one-pot composition-polyvinylbutyral coated at a coverage of 100 mg/ft$^2$, silver behenate coated at a coverage of 10 mg/ft$^2$ silver, Compound A coated at a coverage of 25 mg/ft$^2$ and 3,5-dihydroxybenzoic acid coated at a coverage of 25 mg/ft$^2$.
Transparent Support
Dmax/Dmin 1.4/.04

From the above comparisons, it will be apparent that using inline blended fluids the same Dmax/Dmin was obtained with lesser amounts of silver and acidic material when 3,5-dihydroxybenzoic acid was used as the acidic material, the amount of the benzoic acid being less than the molecular equivalent of 35 mg/ft$^2$ based on 50 mg/ft$^2$ of the salicylic acid. Also, it will be apparent that by using the one-pot composition a slightly higher Dmax was obtained with even lesser amounts of the reactants and less than half the amount of binder.

In addition to its use in single imaging layers as shown above, it will be appreciated that 3,5-dihydroxybenzoic acid also can be used advantageously in recording elements where the reactants, i.e., the thiolactone and the silver are in separate layers. For example, several recording elements were prepared by coating the following layers one and two on a transparent polyethylene terephthalate support. A protective topcoat layer having the same composition given above was coated over layer two.

---

Topcoat Layer
**Layer Two - Red/Green/Blue/Black
Layer One - polyvinylbutyral coated at a coverage of 200 mg/ft$^2$, *silver behenate coated at a coverage of 20 mg/ft$^2$ silver and 3,5-dihydroxybenzoic acid coated at a coverage of 60 mg/ft$^2$.
Transparent Support
*silver behenate coated at a coverage of 18 mg/ft$^2$ for Blue
**Layer Two -

| | |
|---|---|
| Red | 100 mg/ft$^2$ polyvinylbutyral and 50 mg/ft$^2$ Compound B plus 15 mg/ft$^2$ Compound C |
| Red-2 | 100 mg/ft$^2$ polyvinylbutyral and 50 mg/ft$^2$ Compound B |
| Blue | 100 mg/ft$^2$ polyvinylbutyral and 30 mg/ft$^2$ Compound A |
| Green | 100 mg/ft$^2$ polyvinylbutyral and 50 mg/ft$^2$ Compound D |
| Black | 200 mg/ft$^2$ polyvinylbutyral and 80 mg/ft$^2$ Compound E plus 20 mg/ft$^2$ Compound B |

Compound B

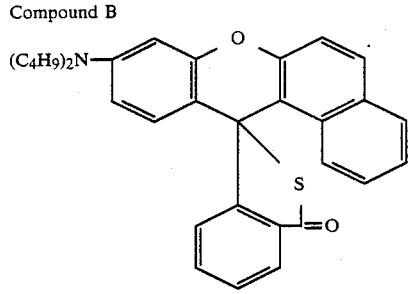

Compound C

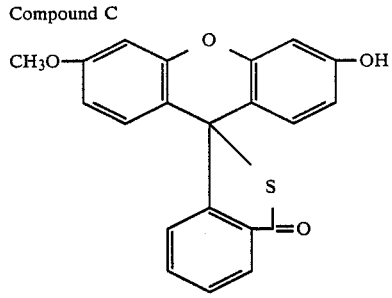

Compound D

-continued

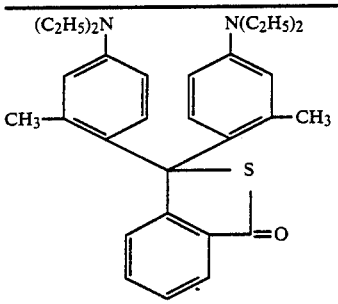

Compound E

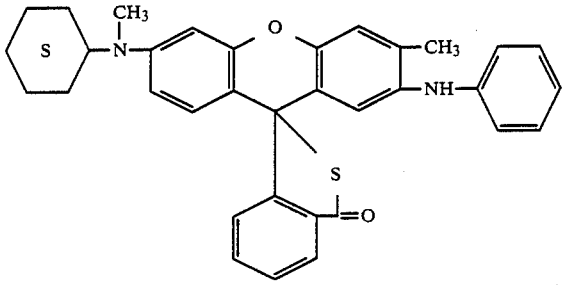

Control elements were prepared that were identical to those above except that 60 mg/ft$^2$ of 3,5-diisopropylsalicylic acid was used as the organic acidic material. For each of the colors the Dmax obtained for the test samples exceeded the control samples by 10 to 35%. Dmin for the test samples in each color was at or below that of the control. Though the test sample for blue contained 10% less silver, it still had a 15% higher Dmax than the control sample as well as a low Dmin, and also, it exhibited excellent performance on accelerated aging tests.

As can be seen from the foregoing, 3,5-dihydroxybenzoic acid when used as the sole organic acidic material provides a stable one-pot coating composition and when used in inline blended coatings and in two layer coatings also provides recording elements having excellent imaging characteristics. In the latter two embodiments, it will be appreciated that 3,5-dihydroxybenzoic acid also can be used in combination with other acidic materials if desired.

Since certain changes may be made in the herein described subject matter without departing from the scope of the invention herein involved, it is intended that all matter contained in the above description and examples be interpreted as illustrative and not in a limiting sense.

We claim:

1. A thermographic recording material comprising a di- or triarylmethane thiolactone dye precursor, silver behenate, a polymeric binder and 3,5-dihydroxybenzoic acid.

2. A recording material as defined in claim 1 which additionally includes a support.

3. A recording material as defined in claim 2 wherein said silver behenate, polymeric binder and 3,5-dihydroxybenzoic acid are carried in a layer on said support and said dye precursor is in the same or an adjacent layer.

4. A recording material as defined in claim 3 wherein said dye precursor is a triarylmethane thiolactone.

5. A recording material as defined in claim 4 wherein said thiolactone is a thiophthalide.

6. A recording material as defined in claim 5 wherein said polymeric binder is polyvinylbutyral.

7. A one-pot coating composition comprising silver behenate, a film-forming polymer, a di- or triarylmethane thiolactone dye precursor and 3,5-dihydroxybenzoic acid dispersed in an organic solvent.

8. A coating composition as defined in claim 7 wherein said polymer is polyvinylbutyral.

9. A coating composition as defined in claim 8 wherein said organic solvent is methyl ethyl ketone.

10. A coating composition as defined in claim 9 wherein said dye precursor is a triarylmethane thiolactone.

11. A coating composition as defined in claim 10 wherein said thiolactone is a thiophthalide.

* * * * *